US005427314A

United States Patent [19]

Hagar

[11] Patent Number: 5,427,314

[45] Date of Patent: Jun. 27, 1995

[54] APPARATUS AND METHOD FOR DELIVERY OF PARTICULATE FUEL AND TRANSPORT AIR

[75] Inventor: Donald K. Hagar, Emmaus, Pa.

[73] Assignee: Damper Design, Inc., Emmaus, Pa.

[21] Appl. No.: 332,501

[22] Filed: Oct. 31, 1994

Related U.S. Application Data

[63] Continuation of Ser. No. 82,477, Jun. 28, 1993, abandoned, which is a continuation-in-part of Ser. No. 931,381, Aug. 18, 1992, abandoned.

[51] Int. Cl.[6] ..... F23C 1/10; F23C 7/00

[52] U.S. Cl. ..... 239/8; 239/404; 239/590; 239/591

[58] Field of Search ..... 431/182, 183, 173; 239/399, 403, 404, 8, 7, 590, 591; 110/264, 261

[56] References Cited

U.S. PATENT DOCUMENTS

| | | | |
|---|---|---|---|
| 1,708,496 | 4/1929 | Clendon . | |
| 1,864,647 | 6/1932 | Geer | 239/424 |
| 2,090,568 | 8/1937 | Andler | 239/399 X |
| 2,917,011 | 12/1959 | Korner | 110/264 |
| 2,921,542 | 1/1960 | Kidwell et al. . | |
| 3,199,476 | 8/1965 | Nettel . | |
| 3,205,656 | 9/1965 | Elverum | 239/416.4 |
| 3,266,550 | 8/1966 | Sick et al. | 239/405 |
| 4,002,127 | 1/1977 | Angus . | |
| 4,155,701 | 5/1979 | Primas | 431/183 |
| 4,307,840 | 12/1981 | Schulze | 239/591 X |
| 4,326,702 | 4/1982 | Oueneau et al. . | |
| 4,504,216 | 3/1985 | Hagar et al. . | |
| 4,515,090 | 5/1985 | Brashears et al. . | |
| 4,574,711 | 3/1986 | Christian . | |
| 4,660,768 | 4/1987 | Bunthoff et al. | 239/423 |
| 4,785,746 | 11/1988 | Roy et al. . | |
| 4,800,825 | 1/1989 | Kuenzly | 110/264 X |
| 4,801,261 | 1/1989 | Hagar . | |
| 5,024,170 | 6/1991 | Santanam et al. . | |

FOREIGN PATENT DOCUMENTS

| | | | |
|---|---|---|---|
| 254098 | 12/1948 | Switzerland | 239/403 |
| 313100 | 6/1929 | United Kingdom . | |
| 2043871 | 10/1980 | United Kingdom | 431/183 |

OTHER PUBLICATIONS

Vatsky, J. and Sweeney, T. W., Development of an Ultra-Low $NO_x$ Pulverized Coal Burner, Mar. 1991, Washington, D.C., pp. 1-17.

Attached Flame Low-$No_x$ Burners, (brochure) Burmeister & Wain Energi A/S.

*Primary Examiner*—Andres Kashnikow
*Assistant Examiner*—Kevin P. Weldon
*Attorney, Agent, or Firm*—Foley & Lardner

[57] ABSTRACT

An apparatus and method for delivery of particulate fuel eliminates the problem of dense phase flow. The problem stems from the formation of undesirable streams of densely concentrated fuel particles, which streams have a deleterious effect on the combustion. In the distribution method and apparatus of the invention, the particulate fuel is induced to follow a different flow path from that of its transport air, as the fuel and transport air pass through the distribution device. The pattern and density of distribution of particulate fuel in the transport air then becomes controlled by the reentrainment of the fuel into the transport air rather than by flow characteristics of the fuel and transport air entering the nozzle. In the distribution device of the invention, the fuel particles are moved in a direction axially away from the furnace and into a space having a reflector wall against which the fuel particles impinge in a rebounding action. The reflector wall sprays the fuel particles into the path of the primary air in a wide dispersion pattern, which ensures good perimeter distribution.

22 Claims, 4 Drawing Sheets

APPARATUS AND METHOD FOR DELIVERY OF PARTICULATE FUEL AND TRANSPORT AIR

This application is a continuation, of application Ser. No. 08/082,477, filed Jun. 28, 1993 now abandoned, which in turn is a continuation-in-part of application Ser. No. 08/931,381, filed Aug. 18, 1992 now abandoned.

BACKGROUND OF THE INVENTION

1. Field of the Invention

The present invention relates to fuel nozzles for burners which feed solid, particulate fuel, such as pulverized coal, to a furnace. The particulate fuel is entrained in transport air, sometimes referred to as primary air, for delivery of the fuel and primary air through the nozzle to the combustion zone of the furnace. Another part of the burner handles the delivery of the combustion air, sometimes referred to as secondary air, for supporting combustion.

2. Discussion of the Prior Art

A common problem in the field is that the solid particulate fuel fed to the furnace by the fuel nozzle of a burner does not enter the combustion zone of the furnace properly distributed. A number of factors typically result in the transport air-to-fuel ratio varying across the transport pipe. Areas in which the particulate fuel is denser than desired are referred to as areas of "dense phase flow." Such areas are also sometimes referred to as "ropes", since the dense phase flows tend to run in streams which follow ever-changing paths, which streams have the appearance of moving "ropes."

Various attempts have been made to minimize the dense phase flow problem and to also provide a uniform distribution of fuel around the perimeter of the nozzle. One approach is use of a splash plate, against which the fuel impinges, followed by a venturi diffuser. Another approach is a centrifugal distributor with an inward conical tip on the coal nozzle to achieve a similar effect. Yet another approach swirls the fuel-air mixture as it enters the nozzle by blocking flow at part of the nozzle entry elbow.

None of these approaches eliminates the dense phase flow or roping effect, and some of the approaches have the added disadvantage of interposing obstructions in the path of the particulate fuel, which obstructions are subject to unacceptably high levels of rapid wear.

SUMMARY OF THE INVENTION

The present invention solves the foregoing problems and provides a highly advantageous distribution of fuel particles in the transport air in an efficient, effective and economical manner. In the present invention, the particulate fuel is in effect "centrifuged" out of the transport air and then reentrained into the transport air. That is, in the distribution system of the present invention, the particulate fuel follows a different flow path from that of the transport air as the fuel and air pass through part of the nozzle. In this way, the pattern and density of distribution of particulate fuel is controlled by the reentrainment of the fuel into the transport air, rather than by the characteristics of the flow of fuel and transport air entering the nozzle.

In the distribution system of the present invention, particulate fuel is moved in a direction axially away from the furnace and into an interior space with a reflector wall, against which reflector wall the particulate fuel impinges in a rebounding pattern. The reflector wall sprays the fuel particles into the path of the primary air with a wide dispersion which ensures good perimeter distribution. The interior space containing the reflector wall is larger in cross-section than the entrance or exit to that space so as to use the expansion/contraction turbulence to assist in fluidizing the particulate fuel.

In its simplest form, the inventive method is a method for delivery of particulate fuel entrained in transport air to a furnace, the method including the steps of separating the transport air from the fuel particles; distributing the fuel particles in a substantially uniform density; and then reentraining the fuel particles with the transport air.

Preferably, the inventive method also includes the step of concentrating the fuel toward the center of the air stream by passing the reentrained transport air and fuel through an exit venturi having an area of decreasing cross-section and an area of increasing cross-section, at a point adjacent the nozzle exit. By passing the fuel stream through the exit venturi, it is possible to increase the density of the fuel stream at the core of the stream.

It is also preferable to reduce the rotation of the stream of fuel particles to in turn control the outward spread of the fuel particles after the fuel particles exit the nozzle by passing the reentrained fuel stream over strakes projecting from the surface of the nozzle.

The nozzle of the present invention includes a nozzle body with a passageway therethrough, which passageway defines the interior space in the nozzle body. An inlet in the nozzle body receives particulate fuel entrained in transport air for directing the fuel and transport air through the passageway in a downstream direction from the inlet to the furnace. The passageway includes a swirl-imparting passageway section communicating with the inlet. This swirl-imparting passageway section circumscribes the central axis of the nozzle, and this same swirl-imparting passageway section also extends in a direction having a rearward axial directional component which is opposite to the forward axial feed direction. That is, the rearward axial directional component is opposite to the direction of flow toward the furnace.

The particle reflector wall in the passageway of the nozzle body faces the interior space in the nozzle body to act as a reflecting barrier in the flow path of fuel particles which are traveling in a flow direction with the rearward axial directional component. The reflector wall acts as a reflecting barrier which changes the direction of fuel particle flow from one having a rearward axial directional component to a direction having a forward axial component, which change in direction is effected by the rebounding of fuel particles against the reflector wall.

An air flow reversing section in the passageway changes the direction of the flow of transport air from a helical flow with a rearward axial component to a flow with a forward axial component. Thus, the transport air follows a flow path different from the flow paths of the rebounding fuel particles.

A discharge section in the passageway of the nozzle body is located downstream of both the swirl-imparting section and the air flow reversing section. The discharge section is for receiving transport air and fuel particles in which the flow directions have been changed from directions having rearward axial components to directions having forward axial components. The discharge section is also for directing such fuel particles in a forward direction toward the furnace. By directing the fuel particles and transport air through different flow paths from one another and by reversing the axial components of the flow directions, the present invention achieves its advantageous distribution of fuel particles in the transport air.

The swirl-imparting passageway section in the nozzle body diminishes in cross-sectional area in a downstream direction as it circumscribes the nozzle axis in a helical manner. This reduction in cross-sectional areas is achieved at a constant radius, i.e. there is no inward spiral. In this way, a uniform distribution of fuel and transport air about the nozzle axis at a constant velocity is achieved along with a symmetrical pattern of fuel and transport air flowing through the discharge section of the nozzle. The swirl-imparting passageway section also has a rearward helical taper as the passageway extends downstream, such that the diminishing cross-section of the swirl-imparting passageway contributes to imparting the rearward axial directional component of flow of fuel and transport air in the interior space of the nozzle.

The particle reflector wall in the nozzle body is of a wear-resistant material, preferably ceramic, capable of withstanding constant impingement of solid fuel particles. The particle reflector wall has a contour corresponding generally with the pattern of swirl imparted to the transport air by the swirl-imparting passageway section. The reflector wall is multi-faceted with a series of facets arrayed around the axis of the nozzle body for deflecting some of the moving fuel particles at a plurality of different points in the passageway. The facets of the reflecting wall are disposed in a part of the nozzle body which has the general interior shape of a toroid truncated along a plane perpendicular to its axis.

The nozzle of the present invention includes a canted passageway section adjacent to and extending downstream of the inlet. This canted section is rearwardly inclined with respect to a plane perpendicular to the nozzle axis. Thus, the canted section contributes to the imparting of the rearward axial directional component to fuel and transport air flowing through the passageway.

The nozzle of the present invention preferably includes an exit venturi located downstream of the discharge section and adjacent the nozzle exit.

In the method of the present invention, a swirling motion having a rearward axial directional component is imparted to the fuel and transport air. A rebounding of fuel particles against the reflector wall changes the flow direction of the fuel particles from a direction having a rearward axial component to a direction having a forward axial component. Similarly, the axial component of the direction of flow of transport air is reversed from a direction having a rearward axial component to a direction having a forward axial component. The air flow reversal is carried out in a manner such that the transport air follows a flow path different from the flow paths of the rebounding fuel particles. The transport air and fuel particles end up flowing in directions having forward axial components at which point they are directed to the furnace in the forward axial feed direction.

The swirl-imparting step of the present invention includes moving the fuel and transport air circumferentially through a passageway of everdiminishing cross-section (but at a constant radius) to thereby achieve constant flow velocity and to effect a uniform circumferential distribution of fuel and transport air. The diminution of the passageway cross-sectional area in the swirl-imparting step also contributes to the imparting of the rearward axial directional component of flow created during the swirl-imparting step.

The rebounding of the fuel particles is carried out by centrifugally directing the fuel particles against the reflector wall as a result of helical or circumferential movement of fuel and transport air through the interior space of the nozzle during the swirl-imparting step. The fuel particles are directed against multiple facets of the particle reflector wall, which facets deflect centrifugally flung fuel particles at a plurality of locations along the nozzle passageway in a region of the passageway where the transport air is moving circumferentially in a swirling pattern.

Prior to the swirl-imparting step, the flow of fuel and transport air is initially guided in a direction having a rearward axial component. This is accomplished by passing the fuel and transport air through a passageway section which is canted with respect to a plane perpendicular to the axial feed direction. In this way the guiding step at least partially contributes to the movement of fuel and transport air in a direction having a rearward axial component.

DETAILED DESCRIPTION OF THE PREFERRED EMBODIMENTS

Figure 1:
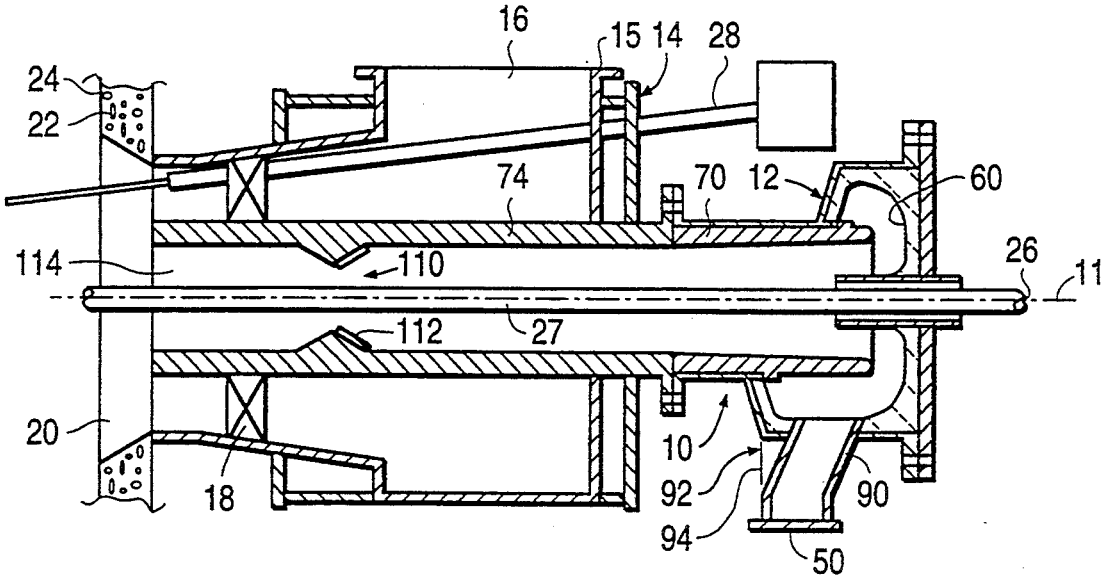
FIG. 1 is a side elevation, partly in section, of a burner installed in a furnace wall, in which burner a fuel nozzle according to the present invention is installed.

In the following description and in the drawing, like reference numerals used among the various figures of the drawing refer to like elements or features.

Figure 3:
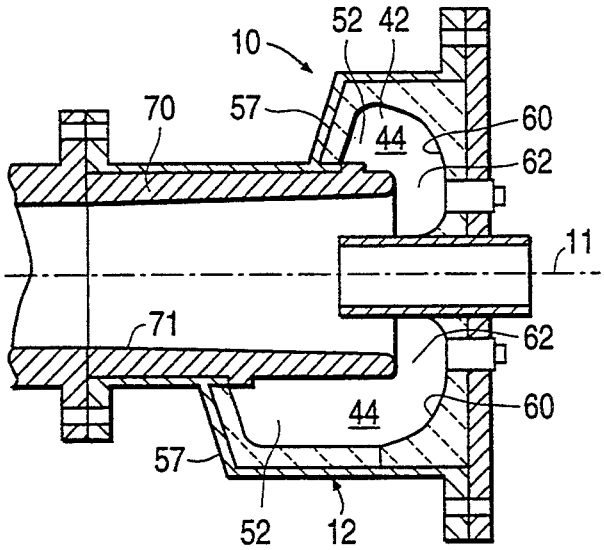
FIG. 3 is a partial sectional view of the fuel nozzle of the invention showing the interior thereof.

Referring to FIGS. 1 and 3, reference numeral 10 refers generally to the fuel nozzle of the present invention, and reference numeral 11 refers to the central axis of the nozzle. Nozzle 10 includes a nozzle body referred to by reference numeral 12, a discharge section 70, and a discharge pipe 74.

FIG. 1 depicts the context in which the nozzle 10 of the present invention is typically used. Nozzle 10 will typically be a component of an overall burner 14 which includes a secondary air register 15 concentrically surrounding part of nozzle 10. Air register 15 handles combustion air, also known as secondary air, for supporting combustion of the fuel delivered by nozzle 10. Air register 15 includes a secondary air supply passageway 16 and turning vanes 18 which impart a swirling motion to the secondary air. Such secondary air, along with particulate fuel and primary air (i.e. transport air) supplied by the nozzle 10, are delivered to throat 20 in a wall 22 of a furnace 24. The delivery of the fuel and primary air along with the secondary combustion air to the furnace provides a combustible fuel air mix in furnace 24.

Centrally located within nozzle 10 is an inspection port 26 defined by an inner pipe 27 extending through the nozzle 10, and indeed through the entire burner assembly 14. The inspection port may be used to visually inspect flame in the furnace 24. Nevertheless, the central cylindrical opening defined by inner pipe 27 may be used for purposes other than an inspection port. This space may be used to house an oil gun (not shown) by which the burner 14 would also be capable of utilizing liquid oil in the combustion process. The inner pipe 27 could house an ignitor. In the particular embodiment shown in FIG. 1, a separate ignitor 28 in another location is shown.

Figure 5:
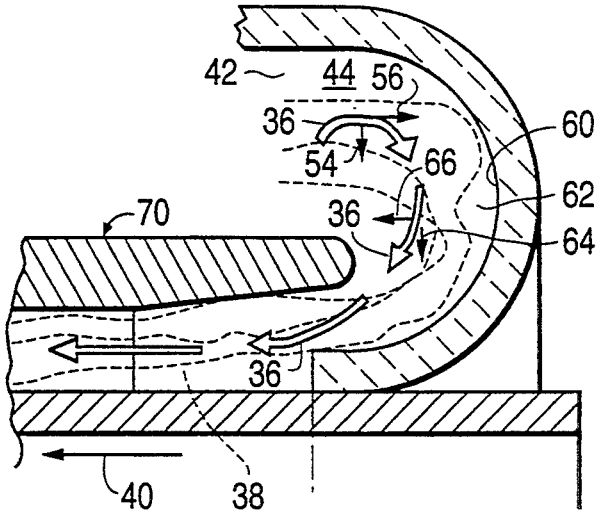
FIG. 5 is a fragmentary sectional view on an enlarged scale of the fuel nozzle of the invention depicting the flow of air and particulate fuel through the nozzle.

Referring to FIG. 5, the flow of transport air, i.e. primary air, through nozzle 10 is depicted by bold, heavy arrows 36. The particulate fuel is depicted by points such as designated by reference numeral 38. Particulate fuel 38 may be any type of solid fuel which has been divided into small parts, such as pulverized coal, shredded sewage sludge, or shredded wood fiber.

Reference numeral 40 in FIG. 5 depicts the forward axial feed direction, i.e. the direction in which the fuel will flow as it moves in a generally straight line to the furnace 24. Reference numeral 42 designates the passageway in nozzle body 12 through which the fuel and transport air flow, and reference numeral 44 depicts an interior space within nozzle body 12, which interior space is part of the passageway 42 and in which interior space 44 the particulate fuel 38 and transport air 36 is handled in a unique and advantageous way.

Figure 2:
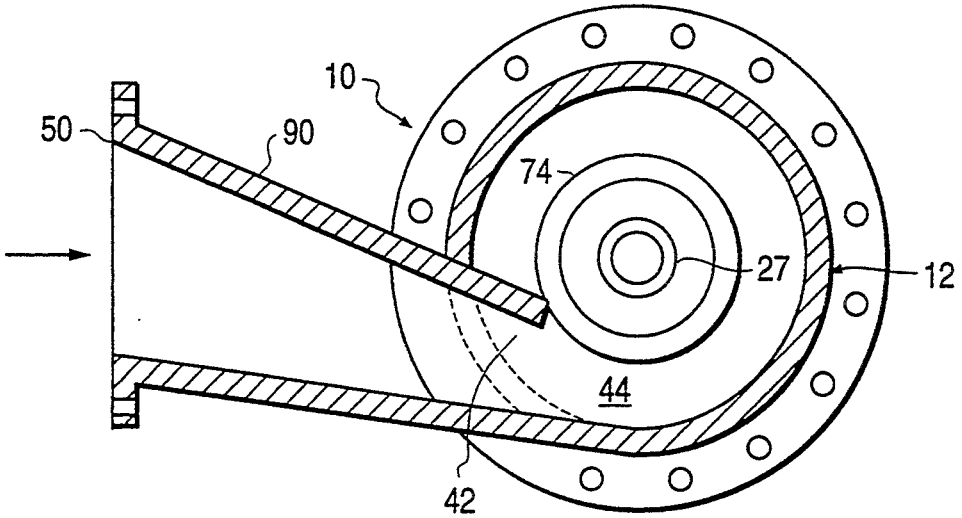
FIG. 2 is an end elevation, partly in section, of the fuel nozzle of the present invention, which elevation specifically shows the nozzle inlet.

Nozzle 10 includes an inlet 50 best seen in FIGS. 1 and 2. Inlet 50 communicates with a swirl-imparting passageway section 52 which is best seen in FIG. 3. The swirl-imparting passageway section 52 circumscribes central axis 11 of the nozzle and directs the fuel and transport air flowing from inlet 50 into a generally helical swirling pattern about central axis 11 of nozzle 10. As best seen in FIG. 3, swirl-imparting passageway section 52 has a diminishing cross-section as the passageway section wraps around axis 11 in a downstream flow direction. This diminishing cross-section is created not by a diminishing radius but rather by a rearward helical conveyance or tapering of front wall 57 (FIG. 3) partially defining passageway section 52 toward the rear of nozzle 10.

The bottom half of FIG. 3 shows the configuration of passageway section 52 at a point near where fuel and transport air from inlet 50 enters passageway section 52. At this point, passageway section 52 has its maximum cross-sectional area, i.e. its maximum interior space. The top half of FIG. 3 shows the configuration of passageway section 52 after the fuel and transport air has undergone approximately 180° of helical flow about axis 11. At this point, the cross-sectional area of passageway section 52 has greatly diminished as a result of a rearward helical tapering of the passageway section effected by the rearwardly helical tapering of front wall 57. By creating a passageway section 52 of diminishing cross-section, but without a diminishing radius, a constant velocity of fuel and transport air about the periphery of nozzle 10 is maintained as is a uniform distribution of fuel and transport air about the periphery of nozzle 10. At the same time, the rearward tapering of passageway section 52 effects a special rearward flow to be described.

In FIG. 5, reference numeral 54 designates the point at which flow direction, as represented by one of the transport air flow arrows 36, is resolved into its rectangular components. At point 54, one of the rectangular components of the flow direction is a rearward axial directional component 56. Thus, as a result of the rearward axial taper of passageway section 52, the fuel and transport air are moved rearwardly, i.e. in a direction opposite to the forward axial feed direction 40.

This rearward flow, coupled with the centrifugal action on the fuel particles 38 created by the helical pattern of flow, causes the fuel particles to impinge on a rearwardly disposed, forwardly facing particle reflector wall 60. The fuel particles strike reflector wall 60 and change their direction in a rebounding action as depicted in FIG. 5. The rebounding creates a scattering of fuel particles, and yet the shape of reflector wall 60, in conjunction with the other components defining the interior space 44 of nozzle 10, ultimately results in an overall change from a flow direction having a rearward axial directional component 56 to a flow direction having a forward axial directional component 66 as shown in FIG. 5 for a point 64 on one of the arrows 36 depicting flow which has begun to move forwardly.

While fuel particles 38 are undergoing their rebounding and scattering action, the transport air undergoes a gentler, less drastic directional change as will be appreciated from FIGS. 3 and 5. The transport air will be curled inwardly and forwardly as it moves into an air flow reversing section 62 of passageway 42, and in particular, of interior space 44. As the transport air is guided in this manner, its direction will change from a direction having a rearward axial directional component to one having a forward axial directional component.

It will be apparent that the transport air follows a flow path which is different from the flow paths of the rebounding fuel particles. The different flow paths will develop as a rearward axial directional component is induced into the flows of the transport air and fuel particles. Transport air and fuel particles then follow their own paths, generally independently of each other, but are ultimately redirected into the same general flow paths as they develop a forward axial directional component of flow. Stated another way, the fuel particles are separated from the transport air, scattered and then reentrained in the transport air. This action will eliminate the otherwise inevitable regions of dense phase flow or "ropes" in the fuel and transport air stream entering the nozzle 10. At the same time, this action also provides for uniform distribution of the fuel and transport air about the periphery of the nozzle.

The transport air and re-entrained fuel particles 38 pass from the passageway section 62 into discharge section 70 and thence to discharge pipe 74 as shown in FIGS. 3 and 5. Discharge section 70 is defined by a delivery venturi 71 shown in enlarged form in FIG. 4. The delivery venturi 71 includes a helical shoulder 73 which mates with the helically tapering front wall 57 of the swirl imparting passageway section 52. The venturi shape 72 of delivery venturi 71 will concentrate the ratio of fuel to transport air toward the center of the flow path, i.e. it will create an increased core density of the fuel stream being delivered to the furnace. This increased core density, in turn, provides improved NOX control.

Figure 4:
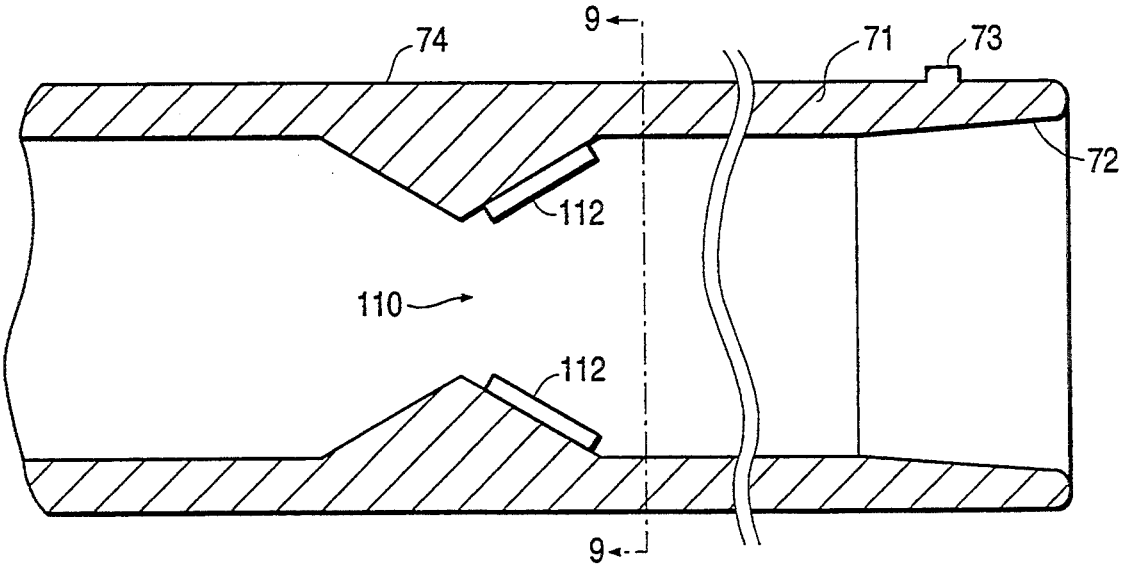
FIG. 4 is a fragmentary sectional view on an enlarged scale of the delivery venturi and secondary venturi which are components of the fuel nozzle of the present invention.
Figure 9:
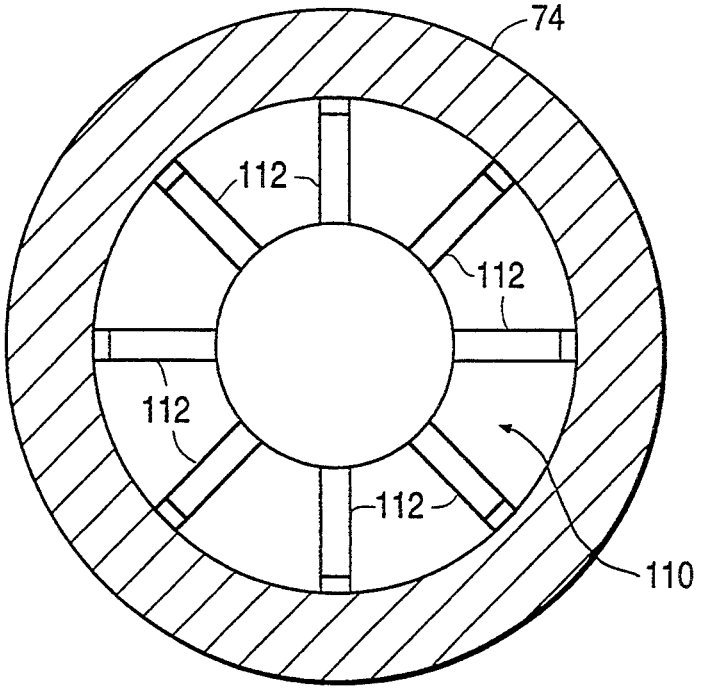
FIG. 9 is a sectional view of the secondary venturi, taken along the line 9—9 of FIG. 4.

Extended length nozzles are nozzles which are longer than three times the inside diameter of the exit. Such extended length nozzles may benefit from an exit venturi located near the exit of the nozzle. The exit venturi 110 is shown in FIGS. 1, 4, and 9. The exit venturi 110 reduces the cross-sectional area of the discharge pipe 74 and then increases the cross-sectional area of the discharge pipe 74 back to approximately its original size. Preferably, the reduction in cross-sectional area is about 50%. The exit venturi 110 is located near the exit end 114 of the nozzle 10. Preferably, the inlet side of the exit venturi 110 is about one to two pipe diameters (a pipe diameter is the inside diameter of the discharge pipe 74 upstream of the exit venturi 110) from the exit end 114 of the nozzle 10. Preferably, the exit venturi inlet cone makes an angle of about 30° with the central axis 11 of the nozzle 10.

The exit venturi 110 helps ensure a proper distribution of the fuel particles, independent of the reflector tooth angle 88, which is discussed in detail below. With the exit venturi 110, the inventive nozzle is less sensitive to changes in the reflector tooth angle 88, thereby ensuring a more uniform density of the fuel particles. The exit venturi concentrates the fuel toward the center of the air stream and increases the density of the fuel stream at the core of the stream.

The inlet side of the exit venturi 110 includes one or more raised strakes or projections 112, and preferably 8 such strakes, equally spaced circumferentially around the exit venturi 110 (FIG. 9). The height of the strakes 112 may be about 1/20 of the inlet diameter of the exit venturi 110. The purpose of the strakes 112 is to reduce the swirl or rotation of the fuel particles to in turn control the outward spread of the fuel particles after the fuel particles exit the nozzle without significantly reducing the swirl of the transport air. This reduction in swirl of the fuel particles helps prevent excessive dispersion of the fuel entering the furnace.

On the outlet side of the exit venturi 110, the cross-sectional area of the discharge pipe 74 is enlarged back to its original size. Preferably, the exit venturi outlet cone makes an angle of about 30° with the central axis 11 of the nozzle 10.

It will be appreciated and understood that the increased core density achieved by delivery venturi 71 is entirely different from the undesirable solid phase flow or "ropes" which the present invention eliminates. The increased core density is a desirable, predictable and symmetrical concentration of fuel toward the center of the stream. The solid phase flow or "ropes" by contrast, are unpredictable concentrations of solid fuel particles which are highly deleterious to optimal combustion. The ropes may also be non-symmetrical and may be constantly fluctuating.

Figure 6:
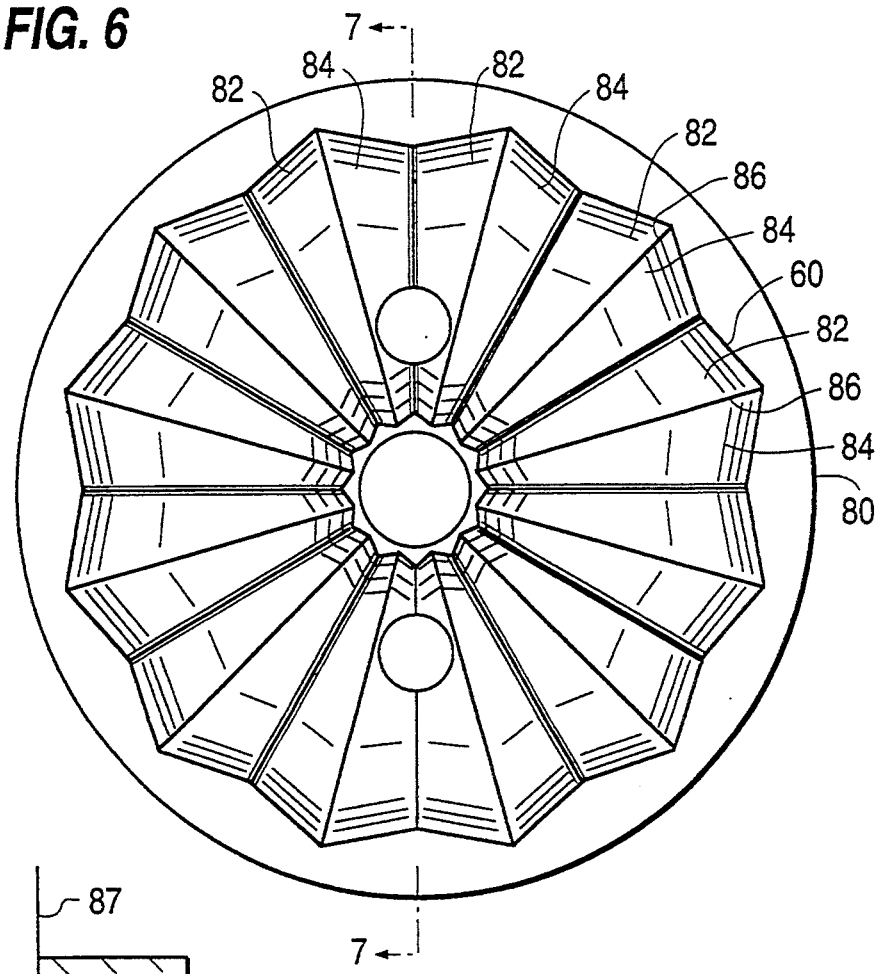
FIG. 6 is an end elevation of a component of the fuel nozzle of the present invention, i.e. the part of the nozzle containing the reflector wall with its faceted teeth.
Figure 7:
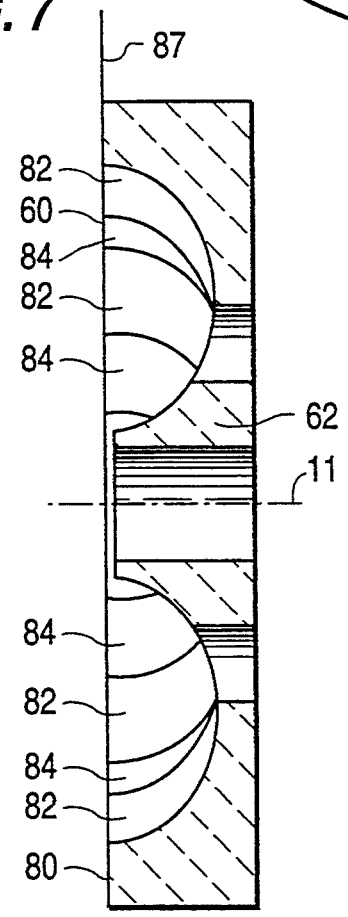
FIG. 7 is a sectional view of the component of FIG. 6 taken on the line 7—7 of FIG. 6.
Figure 8:
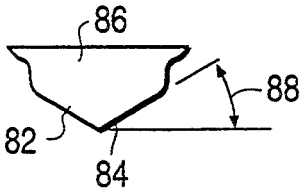
FIG. 8 depicts a tooth which defines a pair of facets in the reflecting wall shown in FIGS. 6 and 7.

Turning to FIGS. 6, 7, and 8, it will be seen that particle reflector wall 60 includes multiple facets 82, 84. That is, reflector wall 60 has multiple reflecting surfaces configured to achieve the optimum reflection of fuel particles as the particles assume a flow path different from the flow path of the transport air. Facets 82, 84 are fashioned in a reflector wall part 80 whose interiorly facing side has the general shape of a toroid truncated along a plane 87 perpendicular to its axis 11. Coupling this toroidal shape with the multiple facets 82, 84 creates a shape for reflector wall 60 resembling that of the interior of fluted tube cake pans sold under the registered trademark BUNDT ®. One difference is that the sections of a BUNDT ® fluted tube pan resembling facets 82, 84 of reflector wall 60 are well spaced from each other, whereas in reflector wall 60 of the present invention, teeth 86 creating facets 82, 84 are disposed immediately adjacent to each other around the entirety of reflector wall part 80.

Although facets 82, 84 have overall curving surfaces in view of the truncated toroidal shape of reflector wall 60, the effect of facets 82, 84 is to present a generally flat surface to the individual moving fuel particles 38 to enhance their rebounding, scattering and dispersion. In view of the generally helical direction of the flow in interior space 44, only one facet of each tooth 86, i.e. either facet 82 or facet 84, will be directly and forcefully impinged by the fuel particles 38. Which of the two facets is impinged is determined by the flow direction. Referring to FIG. 6, if the flow is clockwise, facets 82 will be impinged. If, on the other hand, the flow is counterclockwise, facets 84 will be impinged.

Wear on the reflector wall 60 will occur primarily only on the facets impinged. Thus, cost savings can be achieved by utilizing a reflector wall part 80, which has already undergone maximum acceptable wear in a nozzle having a clockwise flow, as a replacement part for another nozzle having a counterclockwise flow.

Referring to FIG. 8 it is anticipated that a typical angle of disposition of the surfaces of facets 82, 84 with respect to the tooth base should be approximately 30°. Smaller angles of inclination for the facets will improve particle distribution but will result in a greater fuel spread. The higher the angle, the less desirable is the fuel distribution and the better is the axial fuel feed. The latter enhances NOX reduction but provides for less combustion efficiency and uniformity. Thus, it will be seen that the angle of inclination 88 for the facets 82, 84 can be chosen to achieve specific objectives peculiar to specific applications.

All of the parts which have surfaces facing interior space 44 are constructed of a wear resistant material, i.e. a ceramic or ceramic coated material to avoid wear problems. The delivery venturi 71 is constructed of a fired ceramic piece, specifically silicon carbide. Reflector wall part 80, i.e. the part in which reflector wall 60 is defined, is also a fired ceramic piece. In addition, inner pipe 20 includes a shield of wear resistant steel.

Referring to FIGS. 1 and 2, a canted passageway section 90 is disposed immediately adjacent to and just downstream of inlet 50. As best seen in FIG. 1, canted section 90 is rearwardly inclined with respect to a plane 94 perpendicular to the nozzle axis 11. This rearward canting of passageway section 90 contributes to the imparting of the rearward axial directional component 56 to the fuel and transport air flowing through the nozzle body 12. An expected extent of inclination for angle 92 is approximately 5°, with an anticipated range of 4°–7° of inclination.

While the present invention has been illustrated and described by way of specific, preferred, exemplary embodiments, it will be understood that many additional embodiments, variations, and modifications utilizing the present invention are possible within the spirit and scope of the appended claims.

What is claimed is:

1. A nozzle for a burner, which nozzle has a central axis and which nozzle discharges solid, particulate fuel entrained in transport air into a furnace in a forward axial feed direction, the nozzle comprising:

a) a source of particulate fuel, a nozzle body with a passageway therethrough, which passageway defines an interior space in said nozzle body;

b) an inlet in said nozzle body for receiving the particulate fuel entrained in transport air and for directing such fuel and transport air downstream through said passageway;

c) said passageway including a swirl-imparting passageway section communicating with said inlet such that all of the particulate fuel and the transport air are directed into the swirl-imparting passageway section, said swirl-imparting passageway section circumscribing the central axis of the nozzle and said swirl-imparting passageway section also extending in a direction having a rearward axial directional component, which rearward axial directional component is opposite in direction to the forward axial feed direction;

d) a particle reflector wall in said passageway, said reflector wall facing said interior space in said nozzle body to act as a reflecting barrier in the flow path of fuel particles which are traveling in a flow direction having a rearward axial component, which reflecting barrier changes the direction of particle movement from a direction having a rearward axial directional component to a direction having a forward axial directional component, such change in direction being effected by rebounding of the fuel particles against the reflector wall;

e) an air flow reversing section in said passageway for changing the direction of the flow of transport air from a helical flow with a rearward axial directional component to a flow with a forward axial directional component, whereby the transport air follows a flow path different from the flow paths of the rebounding fuel particles;

f) a discharge section in said passageway downstream of both said swirl-imparting section and downstream of said air flow reversing section, said discharge section being for receiving transport air and fuel particles in which the flow directions have been changed from directions having rearward axial components to directions having forward axial components, said discharge section also being for directing such fuel particles in a forward direction toward the furnace; and g) whereby, through directing the fuel particles and transport air through different flow paths from one another and by reversing the axial components of the flow directions, an advantageous distribution of fuel particles in transport air is achieved.

2. A nozzle as claimed in claim 1, wherein said swirl-imparting passageway section diminishes in cross-sectional area in a downstream direction as it circumscribes the nozzle axis to thereby effect a uniform distribution of fuel and transport air about the nozzle axis and to contribute to create a symmetrical pattern of fuel and transport air flowing through the discharge section.

3. A nozzle as claimed in claim 2 wherein the cross-sectional area of said swirl-imparting passageway section tapers rearwardly as said swirl-imparting passageway extends downstream, whereby the diminishing cross-section of the swirl-imparting passageway section contributes to imparting the rearward axial directional component to the flow of fuel and transport air through the swirl-imparting passageway.

4. A nozzle as claimed in claim 1 wherein said particle reflector wall is of wear resistant material capable of withstanding constant impingement of solid fuel particles.

5. A nozzle as claimed in claim 4 wherein said particle reflector wall is of a ceramic material.

6. A nozzle as claimed in claim 1 wherein said particle reflector wall has a contour corresponding generally with the pattern of swirl imparted to the transport air by said swirl-imparting passageway section.

7. A nozzle as claimed in claim 6 wherein said particle reflector wall is multi-faceted, with a series of facets arrayed around the axis of the nozzle body for deflecting some of the moving fuel particles at a plurality of different points in said passageway.

8. A nozzle as claimed in claim 7, wherein said facets of said reflecting wall are disposed in a part of said nozzle body which has the general interior shape of a toroid truncated along a plane perpendicular its axis.

9. A nozzle for a burner, which nozzle has a central axis and which nozzle discharges solid, particulate fuel entrained in transport air into a furnace in a forward axial feed direction, the nozzle comprising:

a) a nozzle body with a passageway therethrough, which passageway defines an interior space in said nozzle body;

b) an inlet in said nozzle body for receiving particulate fuel entrained in transport air and for directing such fuel and transport air downstream through said passageway;

c) said passageway including a swirl-imparting passageway section communicating with said inlet such that all of the particulate fuel and the transport air are directed into the swirl-imparting passageway section, said swirl-imparting passageway section circumscribing the central axis of the nozzle and said swirl-imparting passageway section also extending in a direction having a rearward axial directional component, which rearward axial directional component is opposite in direction to the forward axial feed direction and wherein said passageway includes a canted section adjacent to and extending downstream of said inlet, which canted section is rearwardly inclined with respect to a plane perpendicular to the nozzle axis, said canted section contributing to the imparting of a rearward axial directional component to fuel and transport air flowing through the passageway;

d) a particle reflector wall in said passageway, said reflector wall facing said interior space in said nozzle body to act as a reflecting barrier in the flow path of fuel particles which are traveling in a flow direction having a rearward axial component, which reflecting barrier changes the direction of particle movement from a direction having a rearward axial directional component to a direction having a forward axial directional component, such change in direction being effected by rebounding of the fuel particles against the reflector wall;

e) an air flow reversing section in said passageway for changing the direction of the flow of transport air from a helical flow with a rearward axial directional component to a flow with a forward axial directional component, whereby the transport air follows a flow path different from the flow paths of the rebounding fuel particles;

f) a discharge section in said passageway downstream of both said swirl-imparting section and downstream of said air flow reversing section, said discharge section being for receiving transport air and fuel particles in which the flow directions have been changed from directions having rearward axial components to directions having forward axial components, said discharge section also being for directing such fuel particles in a forward direction toward the furnace;

g) whereby, through directing the fuel particles and transport air through different flow paths from one another and by reversing the axial components of the flow directions, an advantageous distribution of fuel particles in transport air is achieved.

10. A method for delivery of particulate fuel entrained in transport air to a furnace in which the fuel and transport air are discharged into the furnace in a forward axial feed direction, the method comprising the steps of:

a) providing..particulate fuel entrained in transport air and imparting to all of the particulate fuel and transport air a swirling motion having a rearward axial directional component opposite to the forward axial feed direction; then b) effecting rebounding of the fuel particles against a reflector wall to change the flow direction of the fuel particles from a direction having a rearward axial component to a direction having a forward axial component;

c) reversing the axial component of the direction of flow of transport air from a direction having a rearward axial component to a direction having a forward axial component, such air flow reversal being carried out in a manner such that transport air follows a flow path different from the flow paths of the rebounding fuel particles;

d) directing the transport air and fuel particles flowing in directions having forward axial components toward the furnace in the forward axial feed direction;

e) whereby, through directing the fuel particles and transport air through different flow paths from one another and by reversing the axial components of the flow directions, an advantageous distribution of fuel particles in transport air is achieved.

11. A method as claimed in claim 10 in which said swirl-imparting step includes moving the fuel and transport air circumferentially through a passageway section of ever-diminishing cross-section to thereby effect a uniform circumferential distribution of fuel and transport air and to contribute to a discharge of fuel and transport air in a symmetrical pattern.

12. A method as claimed in claim 11 wherein the diminution of the passageway section in said swirl-imparting step also contributes to the imparting of the rearward axial directional component of flow created during said swirl-imparting step.

13. A method as claimed in claim 10 wherein said rebounding step is carried out by centrifugally directing the fuel particles against the reflector wall as a result of the circumferential movement of fuel and transport air imparted therethrough during said swirl-imparting step.

14. A method as claimed in claim 13 wherein the directing of fuel particles takes place against multiple facets of the particle reflector wall, which facets deflect centrifugally flung fuel particles at a plurality of locations along the nozzle passageway in a region of the passageway where the transport air is moving circumferentially in a swirling pattern.

15. A method as claimed in claim 10 including the further step, prior to said swirl-imparting step, of initially guiding the flow of fuel and transport air in a direction having a rearward axial component by passing the fuel and transport air through a passageway section which is canted with respect to a plane perpendicular to the axial feed direction, whereby said guiding step at least partially contributes to the movement of fuel and transport air in a direction having a rearward axial component.

16. The nozzle of claim 1, wherein said discharge section includes a delivery venturi, and, wherein the nozzle further includes, downstream of said delivery venturi, an exit venturi, said exit venturi being disposed adjacent a nozzle exit.

17. The method of claim 10, wherein the directing step includes the step of increasing a ratio of the fuel to the transport air toward a center of the flow paths of the fuel particles.

18. A nozzle for a burner, which nozzle has a central axis and which nozzle discharges solid, particulate fuel entrained in transport air into a furnace in a forward axial feed direction, the nozzle comprising:

a) a nozzle body with a passageway therethrough, which passageway defines an interior space in said nozzle body;

b) an inlet in said nozzle body for receiving particulate fuel entrained in transport air and for directing such fuel and transport air through said passageway in a downstream direction;

c) said passageway including a swirl-imparting passageway section communicating with said inlet such that all of the particulate fuel and the transport air are directed into the swirl-imparting passageway section, said swirl-imparting passageway section circumscribing the central axis of the nozzle;

d) a particle reflector wall in said passageway, said reflector wall facing said interior space in said nozzle body to act as a reflecting barrier in the flow path of fuel particles, which reflecting barrier changes the direction of fuel particle movement, such change in direction being effected by rebounding of the fuel particles against the reflector wall;

e) an air flow changing section in said passageway for changing the direction of the flow of transport air, whereby the transport air follows a flow path different from the flow paths of the rebounding fuel particles;

f) a discharge section in said passageway downstream of both said swirl-imparting section and downstream of said air flow changing section, said discharge section being for receiving transport air and fuel particles in which the flow directions have been changed, said discharge section also being for directing such fuel particles in a forward direction toward the furnace;

g) an exit venturi located downstream of said discharge section and adjacent a nozzle exit; and h) whereby, through directing the fuel particles and transport air through different flow paths from one another, an advantageous distribution of fuel particles in transport air is achieved.

19. A method for delivery of particulate fuel entrained in transport air to a furnace in which the fuel and transport air are discharged into the furnace in a forward axial feed direction, the method comprising the steps of:

a) providing particulate fuel entrained in transport air and imparting to all of the particulate fuel and transport air a swirling motion having a rearward axial directional component opposite to the forward axial feed direction; then b) effecting rebounding of the fuel particles against a reflector wall to change the flow direction of the fuel particles from a direction having a rearward axial component to a direction having a forward axial component;

c) reversing the axial component of the direction of flow of transport air from a direction having a rearward axial component to a direction having a forward axial component, such air flow reversal being carried out in a manner such that transport air follows a flow path different from the flow paths of the rebounding fuel particles;

d) directing the transport air and fuel particles flowing in directions having forward axial components toward the furnace in the forward axial feed direction;

e) concentrating the fuel toward a center of the air stream by passing the transport air and fuel through an exit venturi at a point adjacent a nozzle exit;

f) whereby, through directing the fuel particles and transport air through different flow paths from one another and by reversing the axial components of the flow directions, an advantageous distribution of fuel particles in transport air is achieved.

20. A method for delivery of particulate fuel entrained in transport air to a furnace, the method comprising the steps of:

providing particulate fuel entrained in transport air;

separating all of the transport air from the fuel particles;

distributing the fuel particles in an advantageous pattern; and then reentraining the fuel particles with the transport air.

21. A method for delivery of particulate fuel entrained in transport air to a furnace, the method comprising the steps of:

providing particulate fuel entrained in transport air;

separating all of the transport air from the fuel particles;

distributing the fuel particles in an advantageous pattern;

reentraining the fuel particles with the transport air; and concentrating the fuel toward a center of the air stream by passing the reentrained transport air and fuel through an exit venturi at a point adjacent a nozzle exit.

22. The method of claim 21, further comprising the step of reducing the rotation of the stream of fuel particles to in turn control the outward spread of the fuel particles after the fuel particles exit the nozzle by passing the fuel stream over strakes prior to passage through the exit venturi.

* * * * *

UNITED STATES PATENT AND TRADEMARK OFFICE

CERTIFICATE OF CORRECTION

PATENT NO. : 5,427,314

DATED : June 27, 1995

INVENTOR(S) : Donald K. Hagar

It is certified that error appears in the above-identified patent and that said Letters Patent is hereby corrected as shown below:

Column 11, line 23, "providing..particulate" should read --providing particulate--.

Signed and Sealed this

Twenty-seventh Day of February, 1996

*Attest:*

*Attesting Officer*

BRUCE LEHMAN

*Commissioner of Patents and Trademarks*